US010677053B2

(12) United States Patent
Jaramillo

(10) Patent No.: US 10,677,053 B2
(45) Date of Patent: Jun. 9, 2020

(54) FLUID COMPENSATION SYSTEM FOR DOWNHOLE SAMPLING BOTTLE

(71) Applicant: Schlumberger Technology Corporation, Sugar Land, TX (US)

(72) Inventor: Juan Jose Jaramillo, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 87 days.

(21) Appl. No.: 15/682,729

(22) Filed: Aug. 22, 2017

(65) Prior Publication Data

US 2018/0058213 A1 Mar. 1, 2018

Related U.S. Application Data

(60) Provisional application No. 62/381,379, filed on Aug. 30, 2016.

(51) Int. Cl.
*E21B 49/08* (2006.01)
*E21B 49/10* (2006.01)

(52) U.S. Cl.
CPC ..... *E21B 49/081* (2013.01); *E21B 49/087* (2013.01); *E21B 49/10* (2013.01)

(58) Field of Classification Search
CPC ..... E21B 49/081; E21B 49/087; E21B 49/10; E21B 49/08; E21B 49/082
See application file for complete search history.

(56) References Cited

U.S. PATENT DOCUMENTS

| | | | |
|---|---|---|---|
| 3,095,930 | A | 7/1963 | Kisling, III |
| 3,556,211 | A | 1/1971 | Bohn |
| 5,009,100 | A | 4/1991 | Gruber et al. |
| 5,337,822 | A | 8/1994 | Massie et al. |
| 6,439,307 | B1 | 8/2002 | Reinhardt |
| 7,191,672 | B2 | 3/2007 | Ringgenberg et al. |
| 7,243,536 | B2 | 7/2007 | Bolze et al. |
| 7,246,664 | B2 | 7/2007 | Shammai et al. |
| 7,596,995 | B2 | 10/2009 | Irani et al. |
| 7,621,325 | B2 | 11/2009 | Shammai et al. |
| 7,913,775 | B2 | 3/2011 | Jeffryes et al. |
| 8,371,161 | B2 | 2/2013 | Simpson et al. |
| 8,429,961 | B2 | 4/2013 | Irani et al. |
| 9,506,307 | B2 | 11/2016 | Kinsella |
| 9,771,798 | B2 | 9/2017 | Gilbert et al. |

(Continued)

OTHER PUBLICATIONS

Office Action issued in U.S. Appl. No. 14/571,238, dated Dec. 13, 2016. 5 pages.

(Continued)

*Primary Examiner* — Michael R Wills, III

(57) ABSTRACT

A formation fluid sampling bottle having a first chamber and a first piston slidably disposed within the first chamber and dividing the first chamber into first and second portions. The sampling bottle has a second chamber and a second piston slidably disposed within the second chamber and dividing the second chamber into third and fourth portions. The third portion of the second chamber is fluidly connected with the second portion of the first chamber, and the fourth portion of the second chamber is fluidly connected with a space external to the sampling bottle.

19 Claims, 7 Drawing Sheets

(56) References Cited

U.S. PATENT DOCUMENTS

| | | | | |
|---|---|---|---|---|
| 2004/0129070 | A1 | 7/2004 | Bolze et al. | |
| 2010/0326727 | A1 | 12/2010 | Villareal et al. | |
| 2017/0254198 | A1* | 9/2017 | Dybdahl ..... | E21B 49/081 |

OTHER PUBLICATIONS

Office Action issued in U.S. Appl. No. 14/571,238, dated Mar. 22, 2017. 6 pages.

* cited by examiner

FLUID COMPENSATION SYSTEM FOR DOWNHOLE SAMPLING BOTTLE

CROSS-REFERENCE TO RELATED APPLICATION

This application claims priority to and the benefit of U.S. Provisional Application No. 62/381,379, filed on Aug. 30, 2016, the entirety of which is incorporated herein by reference.

BACKGROUND OF THE DISCLOSURE

Wells are generally drilled into a land surface or ocean bed to recover natural deposits of oil and gas, as well as other natural resources that are trapped in geological formations in the Earth's crust. Formation evaluation and other downhole tools and operations have become increasingly complex and expensive as wellbores are drilled deeper and through more difficult materials. Such wellbores present increasingly harsher environments, where temperature may exceed 250 degrees Celsius and pressure may exceed 30,000 pounds per square inch (PSI).

In various oil and gas exploration operations, it may be beneficial to have information about the geological formations that are penetrated by the wellbore. In some cases, a drilling tool may be provided with devices to test and/or sample the surrounding formation. Sometimes, the drilling tool may be removed and a wireline tool may be deployed into the wellbore to test and/or sample the formation. These samples and/or tests may be used, for example, to locate the hydrocarbon deposits and to predict the production capacity and production lifetime of the formation. Formation evaluation often entails drawing fluid from the formation into a downhole tool and analyzing and/or testing the extracted fluid samples at the surface. In cases where a sample of fluid drawn into the tool, the sample may be collected in one or more sample chambers or bottles positioned within the downhole tool.

Extreme downhole conditions may subject a sampling bottle to a variety of loads, including but not limited to tension, compression, hydraulic force, shock, and vibrations. Such loads can damage the bottle and/or otherwise compromise the accuracy and even operation of the bottle. Furthermore, air trapped within the sampling bottle may cause large pressure differentials, which may damage the bottle and/or cause wellbore fluid to leak into the bottle and/or compromise the quality of the sample formation fluid by altering its petrophysical properties. Wellbore fluid may introduce particulate matter and other contaminants into the bottle, which may accumulate within the bottle and/or adhere to internal components of the bottle, interfering with bottle operations.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces apparatus that include a formation fluid sampling bottle. The formation fluid sampling bottle includes a first chamber, a first piston, a second chamber, and a second piston. The first piston is slidably disposed within the first chamber and divides the first chamber into first and second portions. The second piston is slidably disposed within the second chamber and divides the second chamber into third and fourth portions. The third portion is fluidly connected with the second portion, and the fourth portion is fluidly connected with a space external to the sampling bottle.

The present disclosure also introduces and/or is related to systems that include, utilize, and/or operate in conjunction with such apparatus, and/or other systems related to one or more aspects of such apparatus. The present disclosure also introduces and/or is related to kits having one or more components of such apparatus and/or systems, and/or other kits related to one or more aspects of such apparatus and/or systems. The present disclosure also introduces and/or is related to methods of utilizing, assembling, manufacturing, and/or operating such apparatus, systems, and/or kits, and/or other methods related to one or more aspects of such apparatus, systems, and/or kits.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
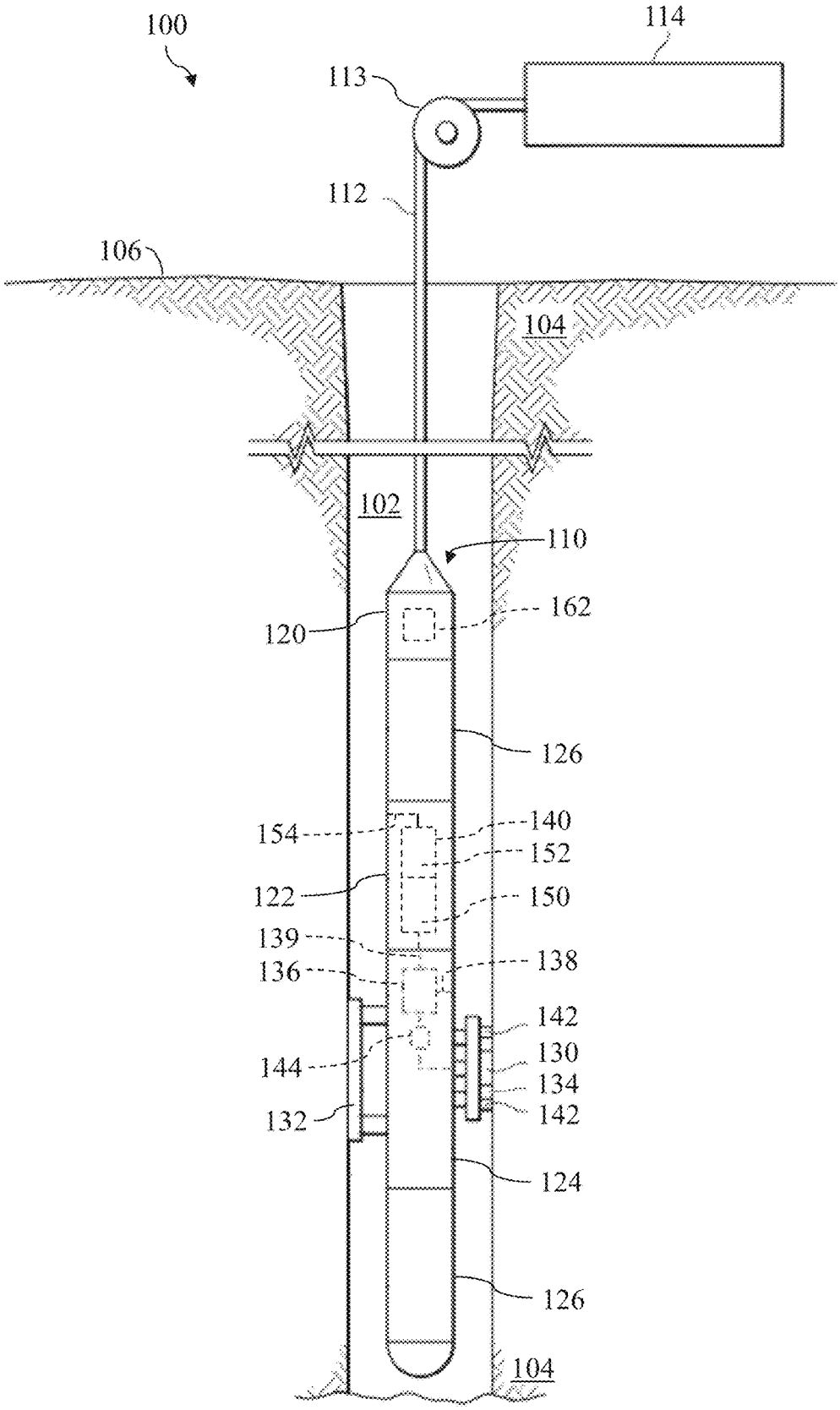
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Also, terms such as "upper," "upward," and "upwardly," as utilized herein to describe an apparatus within the scope of the present disclosure, may be indicative of or be associated with an uphole direction with respect to a wellbore the apparatus may be disposed within. Similarly, terms such as "lower," "downward," and "downwardly," as utilized herein to describe the apparatus, may be indicative of or be associated with a downhole direction with respect to the wellbore in which the apparatus may be disposed. Reference herein to a wellbore also contemplates a vertical, horizontal, and/or otherwise deviated wellbore and/or section(s) thereof.

Example implementations of an apparatus described herein relate generally to a pressure and temperature compensated fluid sample container and chamber utilized in downhole environment. Example implementations of a method described herein relate generally to operation of the fluid sample container during downhole operations, including downhole conveyance and sampling operations.

FIG. 1 is a schematic view of at least a portion of an example implementation of a wellsite environment 100 to which one or more aspects of the present disclosure may be applicable. The wellsite system 100, which may be situated onshore or offshore, comprises a downhole tool 110 operable for engaging a portion of a sidewall of a wellbore 102 penetrating a subterranean formation 104. The downhole tool 110 may be suspended in the wellbore 102 from a lower end of a conveyance means 112, such as a wireline, a slickline, an e-line, coiled tubing, production tubing, and/or other conveyance means, operably coupled with a tensioning device 113 disposed at the wellsite surface 106. The conveyance means 112 may also be communicatively coupled to surface equipment 114, such as may include a controller and/or other processing system for controlling the downhole tool 110. The surface equipment 114 may also include an interface for receiving commands from a surface operator. The surface equipment 114 may also store programs or instructions, including for implementing one or more aspects of the methods described herein.

The downhole tool 110 may comprise a telemetry module 120, a formation test module 124, and a sample module 122. The downhole tool 110 may also comprise additional components at various locations, such as modules 126, each of which may have varying functionality within the scope of the present disclosure. For example, one or more of the modules 126 may be or comprise an electrical power source or a hydraulic power source. The hydraulic power source may comprise a hydraulic fluid containment chamber and a hydraulic fluid pump, such as may be operable to selectively actuate portions of the downhole tool 110, such as a pump 136, an anchoring member 132, and/or a probe assembly 130, described below. One or more of the modules 126 may also be or comprise another instance of the sample module 122.

The formation test module 124 may comprise a selectively extendable probe assembly 130 and a selectively extendable anchoring member 132 that are respectively arranged on opposing sides. The probe assembly 130 may be operable to selectively seal off or isolate selected portions of the sidewall of the wellbore 102. For example, the probe assembly 130 may comprise a sealing pad 134 that may be urged against the sidewall of the wellbore 102 in a sealing manner to prevent movement of formation fluid into or out of the formation 104 other than through the probe assembly 130. The probe assembly 130 may thus be operable to fluidly couple a pump 136 and/or other components of the formation test module 124 to the adjacent formation 104. Accordingly, the formation test module 124 may be utilized to obtain formation fluid samples from the formation 104 by extracting the formation fluid from the formation 104 utilizing the pump 136. The formation fluid samples may thereafter be expelled through a port 138 into the wellbore 102 during a "clean up" operation until the formation fluid extracted from the formation 104 reaches a sufficiently low contamination level, at which time the extracted formation fluid may be directed to a detachable sample container or bottle 140 disposed or installed within the sample module 126. The detachable sample bottle 140 may receive and retain the captured formation fluid for subsequent testing at the surface 106. The detachable sample bottle 140 may be certified for highway and/or other transportation. Portions of the downhole tool 110, such as the formation test module 124, may also comprise a flowline 139 for passing the formation fluid from the probe assembly 130 to other locations and/or components of the downhole tool 110, including the sample bottle 140.

The probe assembly 130 of the formation test module 124 may comprise one or more sensors 142 adjacent a port of the probe assembly 130, among other possible locations. The sensors 142 may be utilized in the determination of petrophysical parameters of a portion of the formation 104 proximate the probe assembly 130. For example, the sensors 142 may be utilized to measure or detect one or more of pressure, temperature, composition, electric resistivity, dielectric constant, magnetic resonance relaxation time, nuclear radiation, and/or combinations thereof, although other types of sensors are also within the scope of the present disclosure. The formation test module 124 may also comprise a fluid sensing unit 144 through which obtained formation fluid may flow, such as to measure properties and/or composition data of the sampled fluid. For example, the fluid sensing unit 144 may comprise one or more of a spectrometer, a fluorescence sensor, an optical fluid analyzer, a density and/or viscosity sensor, and/or a pressure and/or temperature sensor, among others. While the downhole tool 110 is depicted as comprising one pump 136, it may also comprise multiple pumps. The pump 136 and/or other pumps of the downhole tool 110 may also comprise a reversible pump operable to pump in two directions (e.g., into and out of the formation 104, into and out of the sample bottle 140, etc.).

The telemetry module 120 may comprise a downhole control system 162 communicatively coupled to the surface equipment 114. The downhole control system 162 may include a controller/processing system comprising a circuit board and/or various electronic components for controlling operational aspects of the downhole tool 110, and may have an interface for receiving commands from the surface operator. The downhole control system 162 may also store programs or instructions, including for implementing one or more aspects of the methods described herein. For example, the surface equipment 114 and/or the downhole control system 162 may operate independently or cooperatively to control the probe assembly 130 and/or the extraction of fluid samples from the formation 104, such as via control of the pump 136. The surface equipment 114 and/or the downhole control system 162 may also analyze and/or process data obtained from sensors disposed in the fluid sensing unit 144 and/or the sensors 142, store measurements and/or processed data, and/or communicate the measurements and/or processed data to the surface and/or another component for subsequent analysis.

One or more of the modules of the downhole tool 110 depicted in FIG. 1 may be substantially similar to and/or otherwise have one or more aspects in common with corresponding modules and/or components shown in other figures and/or described below. For example, the sampling module 122 and/or the sample bottle 140 may be substantially similar to and/or otherwise have one or more aspects in common with the sampling bottles 300, 400 described below and shown in FIGS. 3 and 4.

The sampling bottle 140 may comprise fluidly connected chambers 150, 152 at least partially filled with a compensation or buffer fluid. One chamber 150 may be fluidly isolated from the wellbore 102 and fluidly connected with the pump 136 to receive the fluid sample extracted from the formation 104 during the sampling operations. The other chamber 152 may be fluidly connected with the wellbore 102 via a port 154, such as may permit the compensation fluid and the formation sample within the chamber 150 to be maintained at the wellbore pressure prior to and/or while the formation fluid sample is pumped into the chamber 150 by the pump 136. Maintaining the compensation fluid within the chamber 150 at the wellbore pressure until the formation fluid sample is pumped into the chamber 150 may prevent a sudden and/or violent inrush of the formation fluid into the chamber 150 that may take place if the chamber 150 was not pressure compensated and remained substantially at surface pressure. Furthermore, maintaining the formation fluid sample at wellbore pressure may prevent or reduce expansion of the formation fluid sample into a gaseous state. Such expansion and/or pressure shock may cause unintended phase separation, asphaltene precipitation, and/or reduced accuracy gas-oil ratio (GOR), which may degrade the petrophysical characteristics of the sample, thus reducing the commercial value of the sample. These aspects are collectively referred to hereinafter as degradation of petrophysical characteristics. Although FIG. 1 shows the sample module 122 containing one bottle 140, it is to be understood that the sample module 122 may contain therein a plurality of bottles 140.

Figure 2:
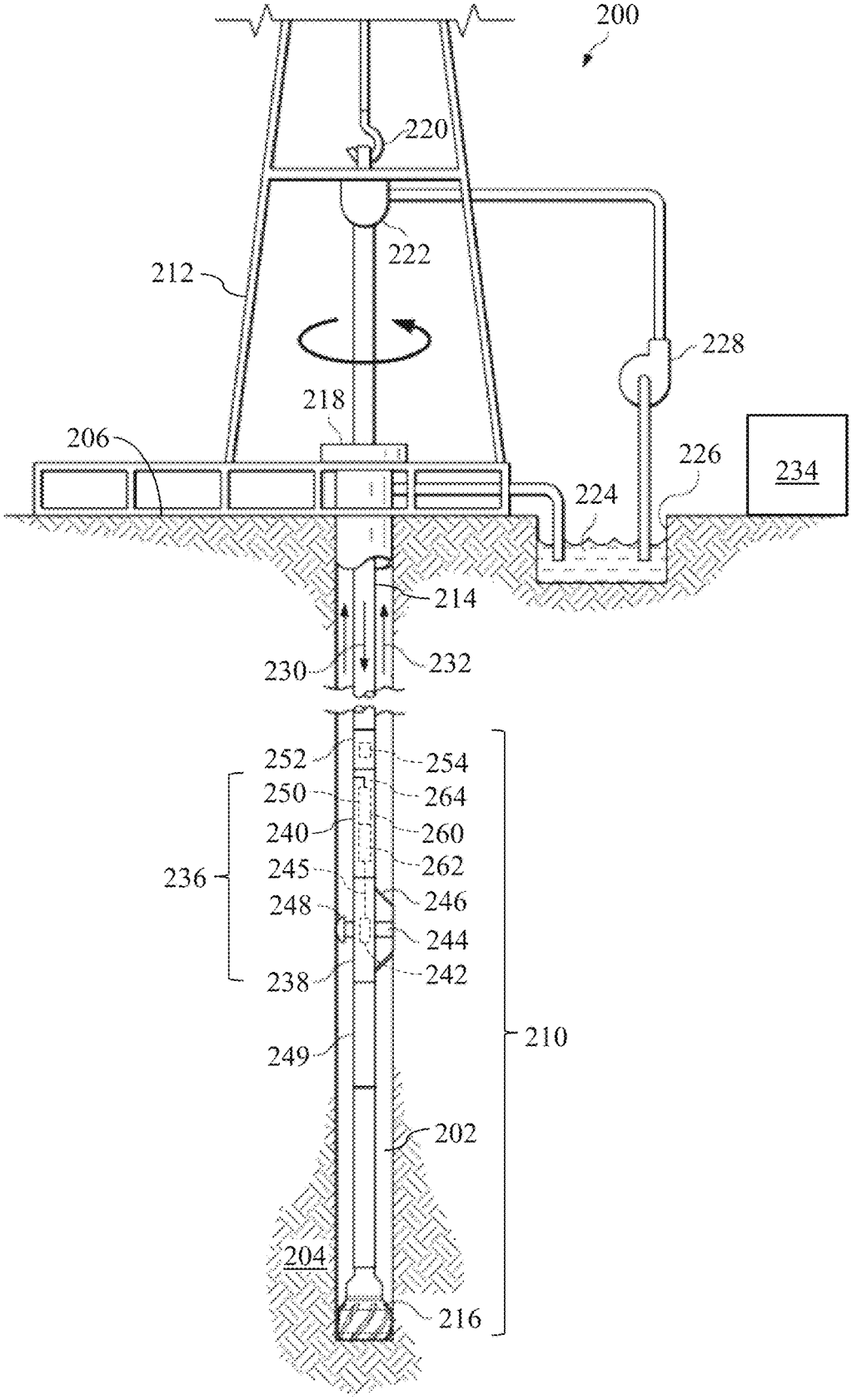
FIG. 2 is a schematic view of at least a portion of an example implementation of apparatus according to one or more aspects of the present disclosure.

FIG. 2 is a schematic view of at least a portion of an example implementation of another wellsite system 200 to which one or more aspects of the present disclosure may be applicable. The wellsite system 200 comprises a downhole tool 210 suspended from a rig 212 at a wellsite surface 206 and into a wellbore 202 via a drill string 214. The downhole tool 210, or a bottom hole assembly (BHA) comprising the downhole tool 210, comprises or is coupled to a drill bit 216 at its lower end that is utilized to advance the downhole tool 210 into a formation 204 and form the wellbore 202. The drill string 214 may be rotated by a rotary table 218 that engages a kelly on the rig floor near the upper end of the drill string 214. The drill string 214 is suspended via a hook 220 and swivel 222 and extends through the kelly in a manner permitting rotation of the drill string 214 relative to the hook 220. However, a top drive may be utilized instead of or in addition to kelly/rotary table 218 arrangements.

The rig 212 is depicted as a land-based platform and derrick assembly utilized to form the wellbore 202 by rotary drilling in a manner that is well known. A person having ordinary skill in the art will appreciate, however, that one or more aspects of the present disclosure may also find application in other applications, including non-land-based drilling.

Drilling fluid 224 is stored in a pit 226 formed at the wellsite 200. A pump 228 delivers drilling fluid 224 to the interior of the drill string 214 via a port in the swivel 222, inducing the drilling fluid 224 to flow downward through the drill string 214, as indicated by directional arrow 230. The drilling fluid 224 exits the drill string 214 via ports in the drill bit 216, and then circulates upward through the annulus defined between the outside of the drill string 214 and a sidewall of the wellbore 202, as indicated by direction arrows 232. In this manner, the drilling fluid 224 lubricates the drill bit 216 and carries formation cuttings up to the surface as it is returned to the pit 226 for recirculation.

At the surface, the wellsite system 200 may comprise surface equipment 234. For example, the surface equipment 234 may include a controller and/or other processing system for controlling the downhole tool 210. Thus, the surface equipment 234 may also be referred to herein as the electronics and processing system 234. The surface equipment 234 may include an interface for receiving commands from the surface operator. The surface equipment 234 may also store programs or instructions, including for implementing one or more aspects of the methods described herein.

The downhole tool 210, which may be part of the BHA, may be positioned near the drill bit 216 (e.g., within several drill collar lengths from the drill bit 216). The downhole tool 210 may also comprise a sampling while drilling (SWD) system 236 comprising a formation test module 238 and a sample module 240, which may be individually or collectively housed in one or more drill collars for performing various formation evaluation and/or sampling functions. The formation test module 238 may be positioned adjacent the sample module 240, and may comprise one or more pumps 242, gauges, sensors, monitors, and/or other devices that may also be utilized for downhole sampling and/or testing. The downhole tool 210 is depicted in FIG. 2 as having a modular construction, with specific components disposed in certain modules. However, the downhole tool 210 may instead be unitary, or select portions of the downhole tool 210 may be modular. The modules and/or the components of the downhole tool 210 may be positioned in a variety of configurations and locations throughout the downhole tool 210.

The formation test module 238 may comprise a fluid communication device 244 that may be positioned in a stabilizer blade or rib 246. The fluid communication device 244 may be or comprise one or more probes, inlets, and/or other means for receiving fluid pumped from the formation 204 and/or the wellbore 202. Portions of the downhole tool 210, such as the formation test module 238, may also comprise a flowline 245 for passing the formation fluid from the fluid communication device 244 to other locations and/or components of the downhole tool 210, including the sample module 240. The fluid communication device 244 may be movable between extended and retracted positions for selectively engaging a wall of the wellbore 202 and acquiring one or more fluid samples from the formation 204. The formation test module 238 may also comprise a back-up piston 248 operable to assist in positioning the fluid communication device 244 against the sidewall of the wellbore 202. Accordingly, the formation test module 238 may be utilized to obtain formation fluid samples from the formation 204 by extracting the formation fluid from the formation 204 utilizing the pump 242. During sampling operations, the extracted formation fluid may be directed via the flowline 245 to a detachable sample container or bottle 250 disposed or installed within the sample module 240. The detachable sample bottle 250 may receive and retain the captured formation fluid for subsequent testing at the surface 206. The detachable sample bottle 250 may be certified for highway and/or other transportation.

The downhole tool 210 may also comprise a telemetry module 252 for communicating with the surface equipment 234. The telemetry module 252 and/or another portion of the downhole tool 210 may comprise a downhole control system 254 in communication with the surface equipment 234. The downhole control system 254 may include a controller and/or other processing system operable to control the downhole tool 210. The downhole control system 254 may also store programs or instructions, including for implementing one or more aspects of the methods described herein. For example, the surface equipment 234 and/or the downhole control system 254 may operate or be operable to control the back-up piston 248, the fluid communication device 244, and the pump 242, such as to control the extraction of the fluid sample from the formation 204. The surface equipment 234 and/or the downhole control system 254 may also analyze and/or process data obtained from sensors disposed in downhole tool 210, store measurements and/or processed data, and/or communicate the measurements and/or processed data to other components for subsequent analysis.

The downhole tool 210 may also comprise additional components at various locations, such as a module 249, which may have varying functionality within the scope of the present disclosure. For example, the module 249 may be or comprise an electrical power source or a hydraulic power source. The hydraulic power source may comprise a hydraulic fluid containment chamber and a hydraulic fluid pump, such as may be operable to selectively actuate the pump 242, the anchoring member back-up piston 248, and/or the fluid communication device 244. The module 249 may also be or comprise another instance of the sample module 240.

One or more aspects of the telemetry module 252, the formation test module 238, the sample module 240, and/or the fluid communication device 244 may be structurally, functionally, and/or otherwise substantially similar to the telemetry module 120, the formation test module 124, the sample module 122, and/or the probe assembly 130, respectively, described above and shown in FIG. 1. Furthermore, one or more of the modules of the downhole tool 210 depicted in FIG. 2 may be substantially similar to and/or otherwise have one or more aspects in common with corresponding modules and/or components shown in other figures and/or described below. For example, the sample module 240 and/or the sample bottle 250 may be substantially similar to and/or otherwise have one or more aspects in common with the sampling bottles 300, 400 described below and shown in FIGS. 3 and 4.

The sampling bottle 250 may comprise fluidly connected chambers 260, 262 at least partially filled with a compensation or buffer fluid. The chamber 260 may be fluidly isolated from the wellbore 202 and fluidly connected with the pump 242 via the flowline 245 to receive the formation fluid extracted from the formation 204 during the sampling operations. The other chamber 262 may be fluidly connected with the wellbore 202 via a port 264, such as may permit the compensation fluid and the formation sample within the chamber 262 to be maintained at a wellbore pressure prior to and/or while the formation fluid sample is pumped into the chamber 262 by the pump 242. Maintaining the compensation fluid within the chamber 262 at the wellbore pressure until the formation fluid sample is pumped into the chamber 262 may prevent a sudden and/or violent inrush of the formation fluid into the chamber 262 that may take place if the chamber 262 was not pressure compensated and remained substantially at surface pressure. Furthermore, maintaining the formation fluid sample at wellbore pressure may prevent or reduce expansion of the formation fluid sample into a gaseous state, which may reduce or eliminate degradation of petrophysical characteristics as described above. Although FIG. 2 shows the sample module 240 containing one bottle 250, it is to be understood that the sample module 240 may contain therein a plurality of bottles 250.

Figure 3:
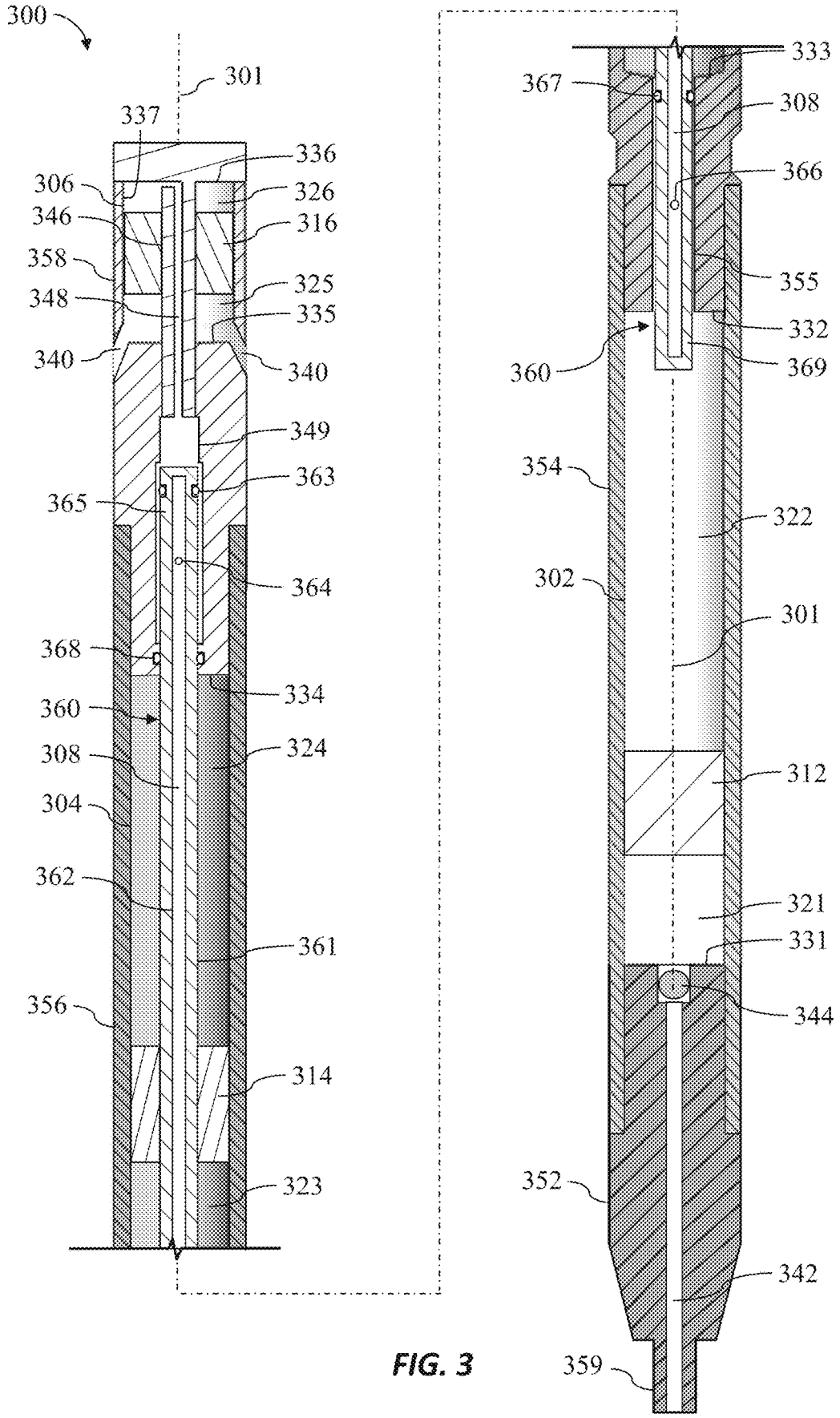
FIG. 3 is a sectional view of at least a portion of an example implementation of apparatus according to one or more aspects of the present disclosure.

FIG. 3 is a sectional view of at least a portion of an example implementation of a single-phase fluid sample container or bottle 300 according to one or more aspects of the present disclosure. The following description refers to FIGS. 1-3, collectively.

The bottle 300 may be disposed or installed within the sample module 122, 240 and operable to receive and retain therein the captured formation fluid for subsequent testing at the wellsite surface 106, 206. The bottle 300 may be a separate and distinct device comprising several interconnected sections, such as a sample inlet section 352, a sample containment section 354, pressurized gas containment section 356, and a fluid compensation section 358. The body or walls of each section 352, 354, 356, 358 may define a plurality of internal spaces or chambers interconnected by one or more fluid channels or pathways. The bottle 300 may comprise an elongated and generally cylindrical geometry having a longitudinal axis 301, such as may permit one or more bottles 300 to be slid, disposed, or otherwise installed within the sample module 122, 240. A lower end of the inlet section 352 may comprise a coupling or connection means 359 to mechanically and fluidly couple the bottle 300 with a corresponding coupling means (not shown) of the sample module 122, 240, such as to retain the bottle 300 within the sample module 122, 240 and fluidly connect the bottle 300 with the flowline 139, 245 of the downhole tool 110, 210. The connection means 359 may comprise pin and box couplings, threaded connectors, fasteners, and/or other mechanical coupling means.

The bottle 300 may comprise one or more spaces or chambers 302, 304, 306 fluidly interconnected via a plurality of fluid cavities, openings, bores, gaps, and/or conduits, which may collectively form a fluid pathway 308. The fluid pathway 308 may be selectively controlled or directed to fluidly connect the chamber 302 with one of the chambers 304, 306. The chambers 302, 304, 306 and the fluid pathway 308 may be collectively operable to contain and communicate fluids, including gasses, gels, and liquids. Each chamber 302, 304, 306 may contain a corresponding piston 312, 314, 316 slidably disposed therein and dividing each chamber 302, 304, 306 into volumes or portions fluidly isolated from each other on opposing sides of each corresponding piston 312, 314, 316. For example, the piston 312 divides the chamber 302 into portions 321, 322, the piston 314 divides the chamber 304 into portions 323, 324, and the piston 316 divides the chamber 306 into portions 325, 326. Each piston 312, 314, 316 may be slidable or otherwise movable between opposing ends of each corresponding chamber 302, 304, 306. For example, the piston 312 may be movable between a lower end 331 and an upper end 332 of the chamber 302, the piston 314 may be movable between a lower end 333 and an upper end 334 of the chamber 304, and the piston 316 may be movable between a lower end 335 and an upper end 336 of the chamber 306.

The bottle 300 may further comprise a plurality of ports extending between the chambers 302, 306 and outside of the bottle 300. For example, the inlet section 352 of the bottle 300 may comprise a fluid pathway or port 342 fluidly connecting the lower portion 321 of the chamber 302 with another portion of the downhole tool 110, 210, such as may facilitate filling of the lower portion 321 with the sample of the formation fluid. For example, the port 342 may extend downwardly through the sample inlet section 352 and the coupling means 359 to fluidly connect the port 342 with the flowline 139, 245, such as may permit the pump 136, 242 to pump the formation fluid into the lower portion 321 of the chamber 302. Fluid communication through the port 342 may be controlled by a fluid valve 344 operable to selectively permit and prevent fluid communication into and/or out of the portion 321 during downhole operations. The fluid valve 344 may be a check valve, such as may prevent the formation fluid injected into the portion 321 from being discharged via the port 342, for example, if the pressure within the upper portion 322 is greater than the pressure of the formation fluid within the lower portion 321.

The compensation section 358 of the bottle 300 may comprise ports 340 fluidly connecting the lower portion 325 of the chamber 306 with a space external to the bottle 300. The ports 340 may extend through the lower end 335 of the chamber 306 and/or through an inner surface or sidewall 337 of the chamber 306 adjacent the lower end 335. The ports 340 may extend diagonally with respect to the axis 301, extending outwardly and downwardly from the lower portion 325 to the external space. The piston 316 may be slidably disposed about a rod 346 comprising a passageway or bore 348 extending at least partially through the rod 346. An upper end of the bore 348 may be fluidly connected with the upper portion 326, while the lower end of the bore 348 may be fluidly connected with an internal fluid channel or cavity 349. The bore 348 and the cavity 349 may form at least a portion of the fluid pathway 308. The chamber 306, piston 316, and the ports 340 may be known in the art as compensation chamber, piston, and ports, respectively.

During downhole operations, such as downhole conveyance and/or sampling operations, the ports 340 may permit wellbore fluid to flow into and out of the lower portion 325 of the chamber 306 to equalize the pressure within the chambers 302, 306 with the ambient wellbore pressure. The pressure (i.e., wellbore pressure) of the wellbore fluid within the lower portion 325 may be transmitted to the formation sample within the lower portion 321 of the chamber 302 via the buffer fluid located within the upper portion 326 of the chamber 306, the upper portion 322 of the chamber 302, and the fluid pathway 308. Accordingly, during downhole conveyance, the increasing pressure within the lower portion 325 urges or increases force applied to the piston 316 in the upward direction to increase the pressure of the buffer fluid within the upper portion 326, the pathway 308, and the upper portion 322 to urge or increase force applied to the piston 312 in the downward direction. If formation or other fluid is present within the lower portion 321, such increase in force will result in a pressure increase within the lower portion 321. Maintaining the chamber 302 at wellbore pressure may prevent a sudden inrush of the formation fluid into the lower portion 321 and may prevent or reduce expansion of the formation fluid into a gaseous state, which may reduce or eliminate degradation of petrophysical characteristics as described above. The piston 316 may isolate the wellbore fluid from the buffer fluid and, thus, isolate the upper portion 326 of the chamber 306, the chambers 302, 304, the pistons 312, 314, and other internal components from particulate matter and other contaminants suspended within the wellbore fluid, which may accumulate within the chambers 302, 304, 306 or other portions of the bottle 300 and interfere with bottle operations. Furthermore, as the wellbore fluid is introduced into the lower portion 325 of the chamber 306 located below the piston 316 and the ports extend downwardly from the lower end 335 of the chamber 306, the contaminants within the wellbore fluid are less likely to settle on or adhere to the piston 316 or collect within the lower portion 325 of the chamber, which may limit the motion of the piston 316. Reducing or preventing wellbore fluid intake may also aid in protecting the inner walls of the upper portion 322 (among other chambers/portions) from foreign (e.g., unknown) contaminants that may mix with the formation sample fluid and alter its qualities, even if such contaminants are present in trace amounts.

The upper portion 326, the upper portion 322, and the fluid pathway 308 may be filled with the buffer fluid at the wellsite surface prior to the downhole operations. Example buffer fluids may include water, such as distilled water, oil, such a lubricating oil, hydraulic fluid, and gel, such as filling gel, among other examples. Although the piston 312 is shown disposed in an intermediate position within the chamber 302, prior to conveying the bottle 300 downhole, the piston 312 may be disposed against the lower end 331 of the chamber 302, such that the chamber 302 may be substantially fully filled with the buffer fluid.

A single-phase sampling bottle, such as the bottle 300, may comprise the pressurized gas containment section 356 operable to maintain the formation sample located within the lower portion 321 of the chamber 302 pressurized and, thus, in a single (i.e., liquid) phase during downhole operations, such as during uphole conveyance. Thus, maintaining the chamber 302 pressurized may prevent or reduce expansion of the formation sample into a gaseous state as the formation sample is conveyed to the surface 106, 206 and the ambient wellbore pressure decreases and temperature goes from formation temperature back to surface (ambient) temperature.

The pressurized gas containment section 356 may contain a pressurized gas within the upper portion 324 of the chamber 304 and the buffer fluid within the lower portion 323 of the chamber 304. The gas within the upper portion 324 may urge or apply a downward force against the piston 314, such as to pressurize the buffer fluid within the lower portion 323. During the downhole operations, after the formation fluid substantially fully fills the chamber 302 such that the piston 312 is adjacent to or in contact with the upper end 332 of the chamber 302, the pressurized buffer fluid within the lower portion 323 may be fluidly connected with the upper portion 322 of the chamber 302, while the upper portion 326 of the chamber 306 is fluidly isolated from the upper portion 322. Accordingly, the pressure of the gas within the upper portion 324 may be transmitted to the formation fluid sample within the lower portion 321 via the buffer fluid within the lower portion 323, the fluid pathway 308, and the upper portion 322. For example, the pressurized buffer fluid within the lower portion 323 may be fluidly connected with the buffer fluid located within the pathway 308 and the upper portion 322 to urge or apply a downward force against the piston 312 to maintain or perhaps increase the pressure of the formation fluid sample within the lower portion 321. Because the buffer fluid within the lower portion 323 is utilized to transmit pressure from the pressurized gas, such buffer fluid within the lower portion 323 may be referred to or known in the art as a power fluid.

The upper portion 324 may be filled with the gas and the lower portion 323 may be filled with the buffer fluid at the surface prior to the downhole operations. Example gas filling the upper portion 324 may be nitrogen. The piston 314 may be disposed in an intermediate position within the chamber 304, such as may permit sufficient amounts of gas and buffer fluid to be filled within the chamber 304. The intermediate piston position may also permit movement of the piston 314 as the formation fluid and/or the buffer fluid expands during uphole conveyance. The gas may be pressurized up to about 20,000 PSI or more.

A fluid valve assembly 360 may be operable to fluidly connect the upper portion 322 of the chamber 302 alternatingly with the upper portion 326 of the chamber 306 or the lower portion 323 of the chamber 304. The valve assembly 360 may comprise a rod 361 extending between the cavity 349 and chamber 302, through the chamber 304, and through the piston 314 located within the chamber 304. The rod 361 may include a passageway or bore 362 extending longitudinally through the rod 361, which may be closed off or plugged at upper and lower ends 365, 369 of the rod 361. The piston 314 and the rod 361 may sealingly engage, such as to prevent or limit fluid flow between the upper and lower portions 324, 323. The rod 361 may be slidably or otherwise movably disposed within the bottle 300. The upper end 365 of the rod 361 may be slidably disposed within the cavity 349 and may comprise a fluid seal 363 and one or more apertures 364 extending through a wall of the rod 361. The apertures 364 may be located below the fluid seal 363 and fluidly connect the bore 362 and an area external to the rod 361, such as the cavity 349. The cavity 349 may comprise fluid seal 368 operable to engage the rod 361 below the apertures 364 to fluidly isolate the chamber 349 from the upper portion 324 of the chamber 304. The lower end 369 of the rod 361 may be slidably disposed within a channel or cavity 355 extending between the upper portion 322 of the chamber 302 and the lower portion 323 of the chamber 304. At least a portion of the lower end 369 may extend into the upper portion 322. The rod 361 may comprise a fluid seal 367 and one or more apertures 366 extending through a wall of the rod 361. The apertures 366 may be located below the fluid seal 367 and fluidly connect the bore 362 and an area external to the rod 361, such as the cavity 355. The apertures 364, the bore 362, the apertures 366, and the cavity 355 may form at least a portion of the fluid pathway 308.

During sampling operations, the rod 361 may be shifted or moved between a first or lower position and a second or upper position. In the first rod position, shown in FIG. 3, the valve assembly 360 fluidly isolates the lower portion 323 of the chamber 304 and permits the buffer fluid to flow between the upper portion 326 of the chamber 306 and the upper portion 322 of the chamber 302. In the first rod position, the fluid seal 367 at the lower end 369 of the rod 361 engages an inner surface of the cavity 355 and the fluid seal 363 at the upper end 365 of the rod 361 does not engage an inner surface or sidewall of the cavity 349. Accordingly, the buffer fluid within the upper portion 326 may flow through the bore 348 and the cavity 349 around the rod 361 and the seal 363 and through the bore 362 via the apertures 364. The buffer fluid may further flow through the apertures 366 and the cavity 355 around the rod 361 to fluidly connect the bore 362 and the upper portion 322. The fluid seal 367 prevents the buffer fluid within the lower portion 323 to flow through the cavity 355 around the rod 361 into the upper portion 322, thus fluidly isolating the pressurized buffer fluid within the lower portion 323. In the second rod position (not shown), the valve assembly 360 fluidly isolates the upper portion 326 of the chamber 306 and permits the buffer fluid to flow between the lower portion 323 of the chamber 304 and the upper portion 322 of the chamber 302. In the second rod position, the fluid seal 363 engages the sidewall of the cavity 349 preventing flow of the buffer fluid between the cavity 349 and the bore 362 via the apertures 364. In the second rod position, the fluid seal 367 may be positioned outside of the cavity 355 to permit the buffer fluid within the lower portion 323 to flow through the cavity 355 around the rod 361 to fluidly connect the lower portion 323 and the upper portion 322.

Figure 4:
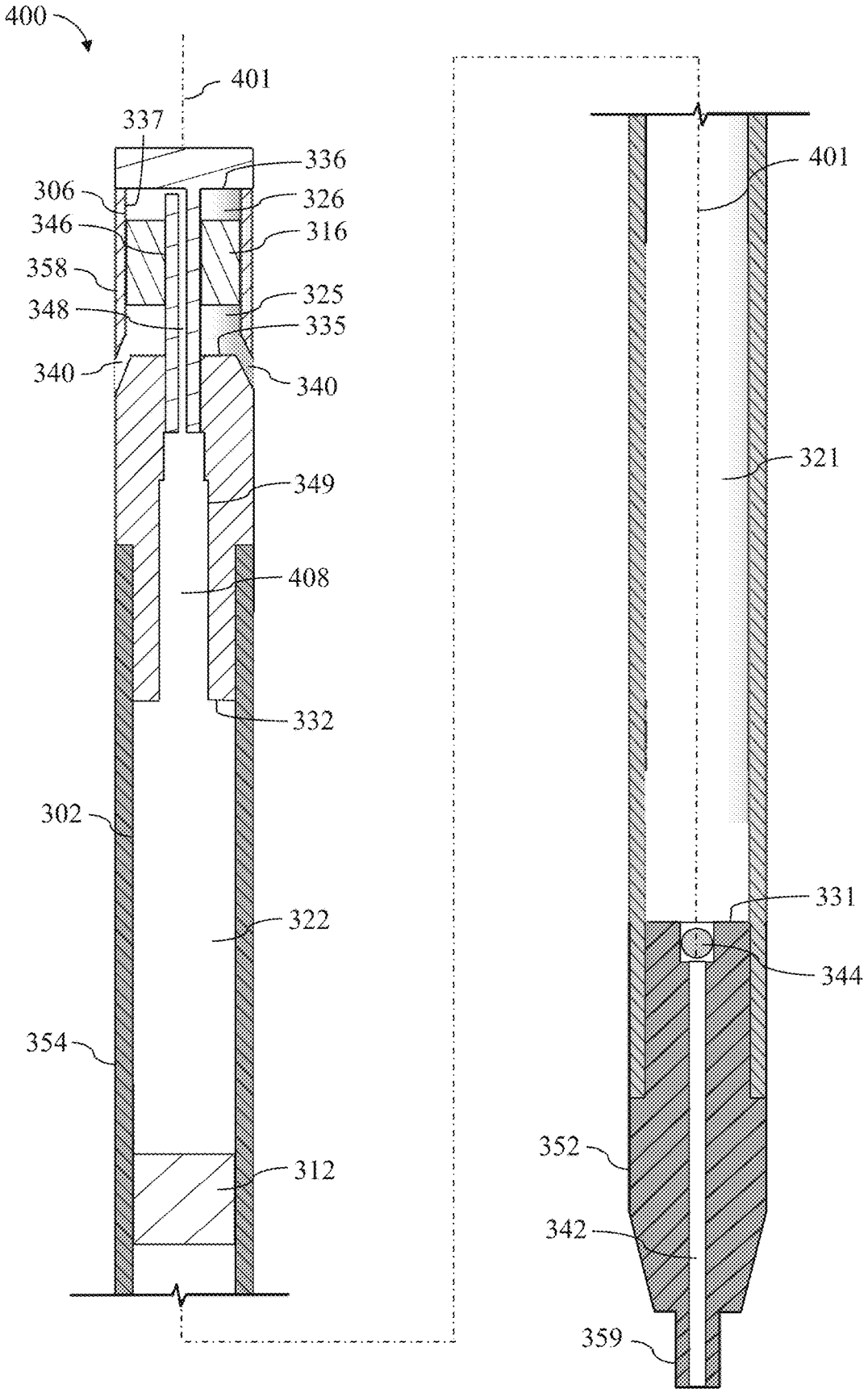
FIG. 4 is a sectional view of at least a portion of an example implementation of apparatus according to one or more aspects of the present disclosure.

FIG. 4 is a sectional view of at least a portion of an example implementation of a multi-phase fluid sample container or bottle 400 according to one or more aspects of the present disclosure. The bottle 400 comprises one or more similar features of the bottle 300 shown in FIG. 3, including where indicated by like reference numbers, except as described below. The following description refers to FIGS. 1-4, collectively.

Similarly to the bottle 300, the bottle 400 may be disposed or installed within the sample module 122, 240 and operable to receive and retain therein the captured formation fluid for subsequent testing at the wellsite surface 106, 206. The bottle 400 may be a separate and distinct device comprising several interconnected sections, such as a sample inlet section 352, a sample containment section 354, and a fluid compensation section 358. Unlike the bottle 300, the bottle 400 may not include the pressurized gas containment section 356. The bottle 400 may comprise an elongated and generally cylindrical geometry having a longitudinal axis 401, such as may permit one or more bottles 400 to be slid, disposed, or otherwise installed within the sample module 122, 240. A lower end of the inlet section 352 may comprise a coupling or connection means 359 to mechanically and fluidly couple the bottle 400 with a corresponding coupling means (not shown) of the sample module 122, 240.

The bottle 400 may comprise one or more spaces or chambers 302, 306 fluidly connected via one or more fluid cavities, bores, and/or conduits, which may collectively form a fluid pathway 408. The chambers 302, 306 and the fluid pathway 408 may be collectively operable to contain and communicate fluids, including gasses, gels, and liquids. Each chamber 302, 306 may contain a corresponding piston 312, 316 slidably disposed therein and dividing each chamber 302, 306 into volumes or portions fluidly isolated from each other on opposing sides of each corresponding piston 312, 316. For example, the piston 312 divides the chamber 302 into portions 321, 322 and the piston 316 divides the chamber 306 into portions 325, 326. Each piston 312, 316 may be slidable or otherwise movable between opposing ends of each corresponding chamber 302, 306. For example, the piston 312 may be movable between a lower end 331 and an upper end 332 of the chamber 302 and the piston 316 may be movable between a lower end 335 and an upper end 336 of the chamber 306.

The bottle 400 may further comprise a plurality of ports extending between the chambers 302, 306 and outside of the bottle 400. For example, the inlet section 352 of the bottle 300 may comprise a port 342 fluidly connecting the lower portion 321 of the chamber 302 with another portion of the downhole tool 110, 210, such as may facilitate filling of the lower portion 321 with the sample of the formation fluid. Fluid communication through the port 342 may be controlled by a fluid valve 344 operable to selectively permit and prevent fluid communication into and/or out of the lower portion 321 during downhole operations.

The compensation section 358 of the bottle 400 may comprise ports 340 fluidly connecting the lower portion 325 of the chamber 306 with a space external to the bottle 400. The ports 340 may extend through the lower end 335 of the chamber 306 and/or through an inner surface or sidewall 337 of the chamber 306 adjacent the lower end 335. The piston 316 may be slidably disposed about a rod 346 comprising a passageway or bore 348 extending at least partially through the rod 346. An upper end of the bore 348 may be fluidly connected with the upper portion 326, while the lower end of the bore 348 may be fluidly connected with an internal fluid cavity 349. The bore 348 and the cavity 349 may form at least a portion of the fluid pathway 408.

During downhole operations, such as downhole conveyance and/or sampling operations, the ports 340 may permit wellbore fluid to flow into and out of the lower portion 325 of the chamber 306 to equalize the pressure within the chambers 302, 306 with the ambient wellbore pressure. The wellbore pressure within the lower portion 325 may be transmitted to the formation sample within the lower portion 321 of the chamber 302 via the buffer fluid within the upper portion 326 of the chamber 306, the upper portion 322 of the chamber 302, and the fluid pathway 408. Accordingly, during downhole conveyance, the increasing pressure within the lower portion 325 urges or increases force applied to the piston 316 in the upward direction to increase the pressure of the buffer fluid within the upper portion 326, the pathway 408, and the upper portion 322 to urge or increase force applied to the piston 312 in the downward direction. If formation or other fluid is present within the lower portion 321, such increase in force will result in a pressure increase within the lower portion 321.

A multi-phase sampling bottle, such as the bottle 400, may not comprise the pressurized gas containment section 356 and, thus, may permit the formation sample located within the lower portion 321 of the chamber 302 to decrease in pressure and expand during downhole operations, such as during uphole conveyance. Accordingly, at least a portion of the formation fluid sample may expand into a gaseous state as the formation sample is conveyed to the surface 106, 206.

Figure 5:
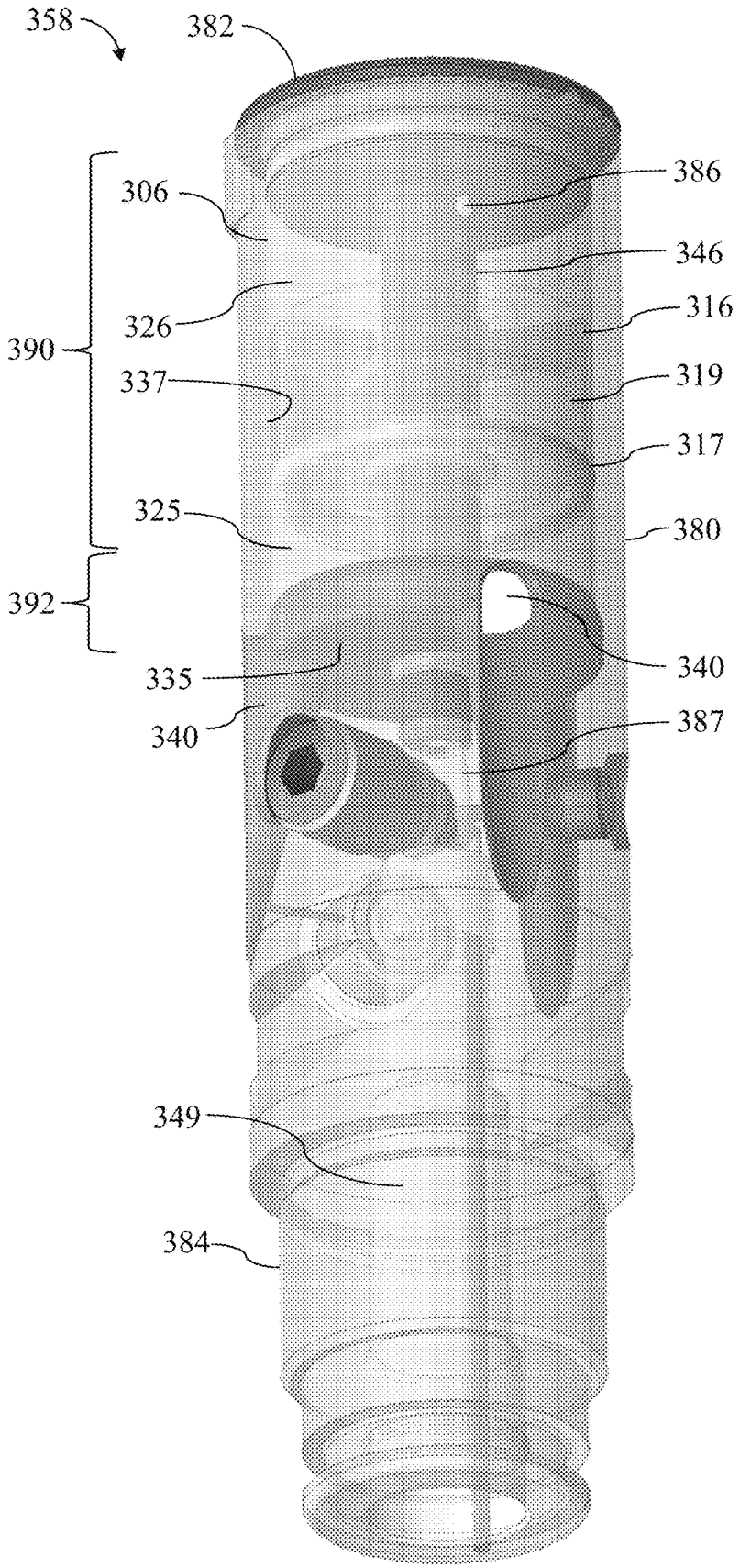
FIG. 5 is a perspective sectional view of a portion of the apparatuses shown in FIGS. 3 and 4 according to one or more aspects of the present disclosure.
Figure 6:
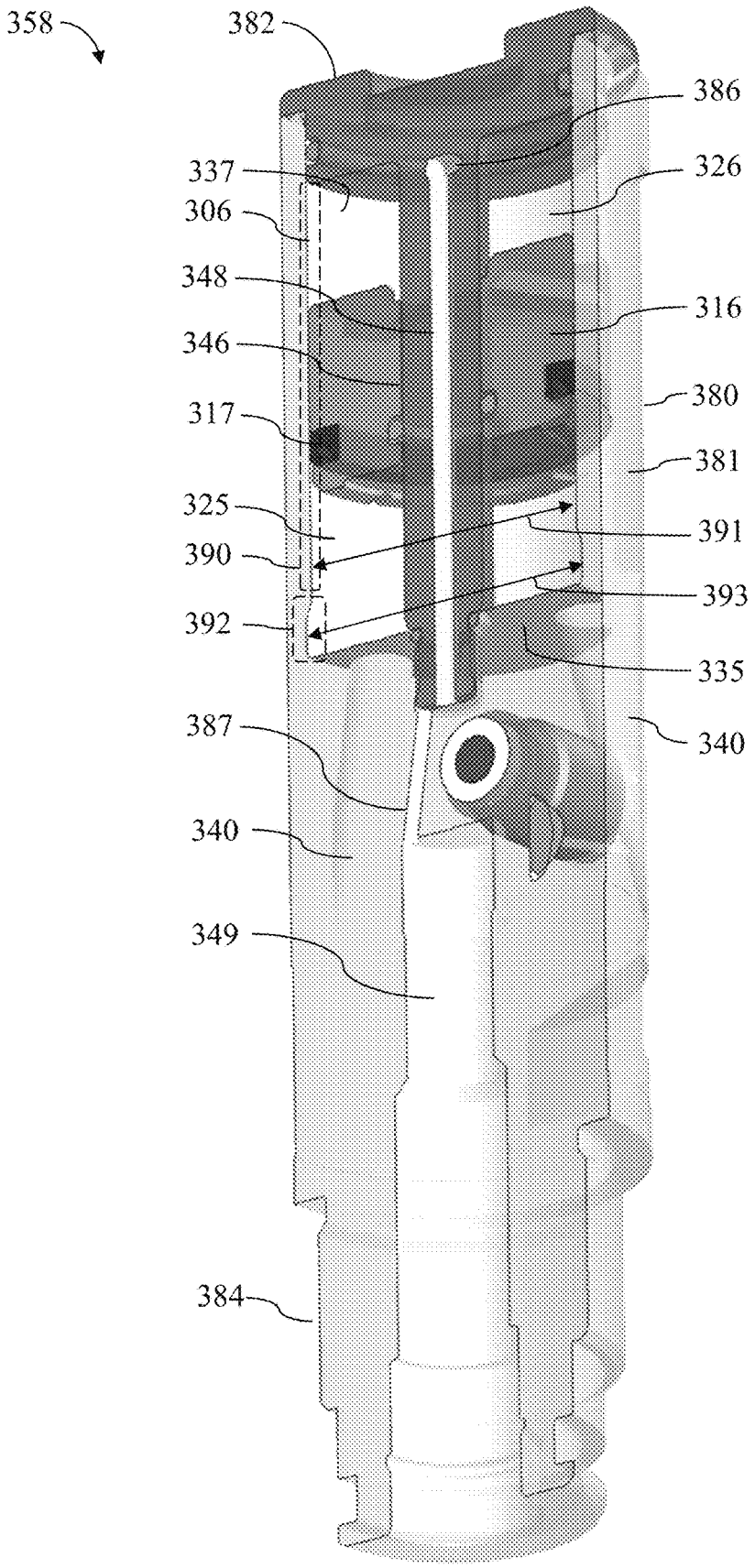
FIG. 6 is another perspective sectional view of the apparatus shown in FIG. 5 according to one or more aspects of the present disclosure.
Figure 7:
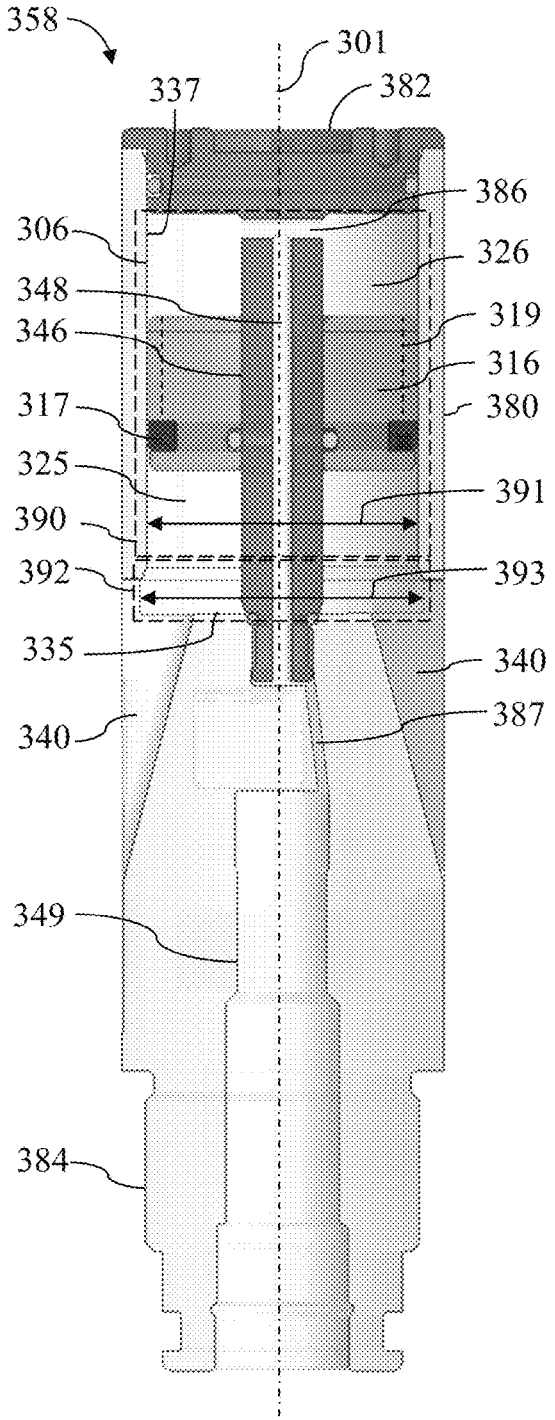
FIG. 7 is a side sectional view of the apparatus shown in FIGS. 5 and 6 according to one or more aspects of the present disclosure.
Figure 8:
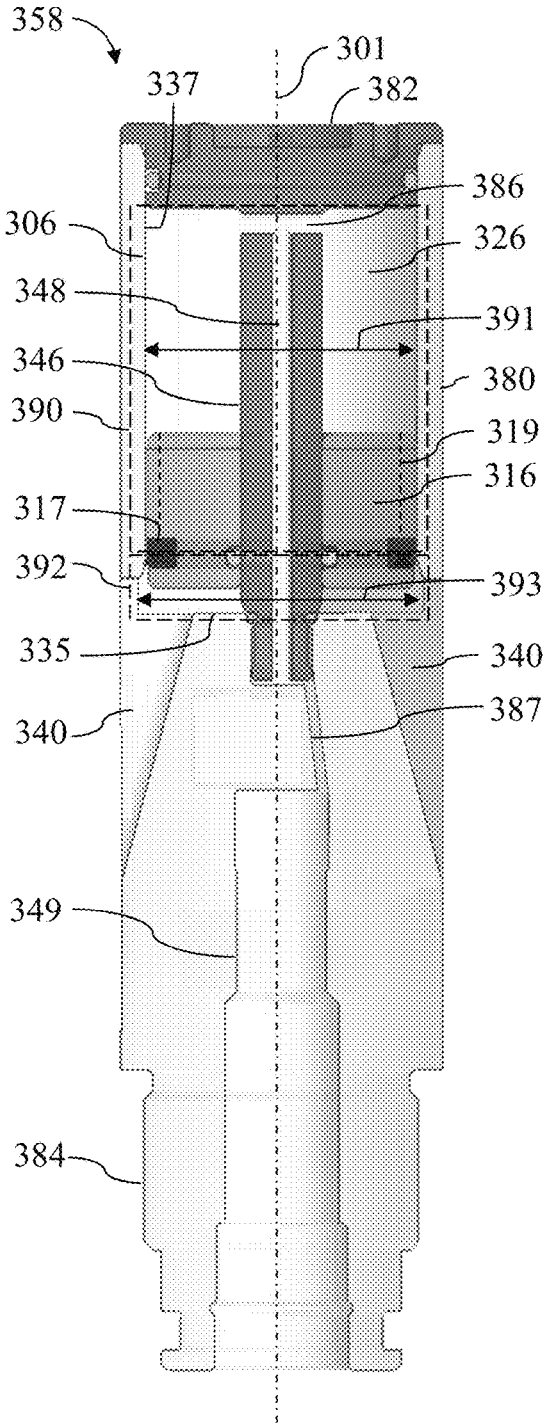
FIG. 8 is another sectional view of the apparatus shown in FIG. 7 in a different stage of operation.

FIGS. 5 and 6 are perspective sectional views of the compensation section 358 of the bottles 300, 400 shown in FIGS. 3 and 4 according to one or more aspects of the present disclosure. FIGS. 7 and 8 are side sectional views of the compensation section 358 shown in FIGS. 5 and 6 at different stages of downhole operation according to one or more aspects of the present disclosure. The following description refers to FIGS. 3-8, collectively.

The figures show the compensation section 358 of the bottles 300, 400 comprising a body or housing 380 and an end cap 382 sealingly connected at an upper end of the housing 380. Lower end of the housing 380 may include a mechanical interface, a sub, and/or other means 384 for mechanically and fluidly coupling the compensation section 358 with a corresponding connection means of another section of the bottle 300, 400. The connection means 384 may comprise pin and box couplings, threaded connectors, fasteners, and/or other mechanical coupling means. An upper portion of the housing 380 and the end cap 382 may define the chamber 306 while a lower portion of the housing 380 may define the cavity 349. The chamber 306 may contain the rod 346 axially extending therethrough and the piston 316 sealingly engaging the rod 346 and the sidewall 337 of the chamber 306. The bore 348 may extend longitudinally through the rod 346 and an aperture 386 may extend laterally through an upper end of the rod 346 to fluidly connect the bore 348 with the upper portion 326 of the chamber 306. The bore 348 may be fluidly connected with the cavity 349 via a fluid channel 387.

The compensation section 358 may further comprise the ports 340 extending through the housing 380 between the lower portion 325 of the chamber 306 and a space external to the compensation section 358. The ports 340 may extend from the lower end 335 of the chamber 306 and/or from the inner surface or sidewall 337 of the chamber 306 adjacent the lower end 335. The ports 340 may extend diagonally with respect to the axis 301, extending outwardly and downwardly from the lower portion 325 to the external space. At least a portion of the ports 340 may extend perpendicularly with respect to the axis 301.

The sidewall 337 of the chamber 306 may comprise a substantially continuous or constant upper region 390 having a diameter 391 and operable to fluidly seal against a fluid seal 317 of the piston 316. The sidewall 337 of the chamber 306 may further comprise a lower region 392 adjacent the bottom end 335 of the chamber 306 and having a diameter 393. The diameter 393 may be substantially larger than the diameter 391, such as may prevent the fluid seal 317 from sealingly engaging the sidewall 337 while within the lower region 392 and permit fluid flow around the seal 317 and the piston 316. The sidewall 337 along the lower region 392 may not be substantially continuous or constant, as the ports 340 may extend out of the chamber 306 along the lower region 391, which may also prevent the fluid seal 317 from sealingly engaging the sidewall 337 and permit fluid flow around the seal 317. The piston 316 may further comprise fluid pathways or channels 319 extending along an outer surface of the piston 316 substantially parallel to the axis 301. Accordingly, when the piston 316 or a portion of the piston 316, such as the fluid seal 317, is located within the upper region 390, as shown in FIGS. 5, 6, and 7, fluid flow between the upper and lower portions 326, 325 of the chamber 306 is not permitted. However, when a portion of the piston 316 or the fluid seal 317 move into the lower region 392, as shown in FIG. 8, the ports 340 and the increased diameter 393 of the lower region 392 permit fluid flow between the upper portion 326 and the ports 340 to permit fluid flow between the upper portion 326 and the space external to the compensation section 358. Although the fluid seal 317 is shown as a cup seal, it is to be understood that the fluid seal 317 may be or comprise an O-ring or another fluid-sealing element.

The present disclosure is further directed to methods of operation of the bottles 300, 400 shown in FIGS. 3 and 4. Example methods within the scope of the present disclosure include methods of utilizing or operating the bottles 300, 400 at the well sites 100, 200 during downhole operations, including downhole conveyance, sampling, and uphole conveyance.

The following description is directed to a method of operating the single-phase bottle 300 during downhole operations and refers to FIGS. 1-3 and 5-8. Prior to downhole conveyance of the tool 110, 210, the bottle 300 may be filled with fluids. For example, the upper portion 324 of the chamber 304 may be primed with nitrogen or another gas and the lower portion 323 of the chamber 304 may be filled with the buffer fluid to pressurize gas within the upper portion 324. Also, the upper portion 326 of the chamber 306, the upper portion 322 of the chamber 302, and the fluid pathway 308, may be primed with the buffer fluid such that the piston 312 moves against the bottom end 331 of the chamber 302 and the piston 316 is located in an intermediate location within the chamber 306. The rod 361 may be set in the first position, such as to fluidly connect the upper portion 326 of the chamber 306 with the upper portion 322 of the chamber 302. One or more bottles 300 may then be installed within or form at least a portion of the sample module 122, 240, such that the ports 342 are fluidly connected with the flowlines 139, 245 and the ports 340 are exposed to the space external to the sample module 122, 240. The sample module 122, 240 may then be connected with the formation test module 124, 238 or otherwise as a part of the downhole tool 110, 210, which may then be conveyed within the wellbore 102, 202.

During downhole conveyance, as the ambient wellbore pressure increases, wellbore fluid flows into the lower portion 325 via the ports 340 as the volume of the buffer fluid within the upper portion 326 and the upper portion 322 is being compressed and, thus decreased, causing the piston 316 to move upward toward the end 336 of the chamber 306. As the volume of the buffer fluid within the upper portion 322 decreases, the buffer fluid within the upper portion 326 flows into the upper portion 322 via the fluid pathway 308. Accordingly, the pressure of the buffer fluid within the upper portion 322 and the pressure within the lower portion 321 is maintained substantially equal with the ambient wellbore pressure. As the ambient wellbore temperature increases, the buffer fluid within the upper portion 322 may expand. The resulting increase in buffer fluid volume may cause the buffer fluid to flow from the upper portion 322 to the upper portion 326 via the fluid pathway 308 and, thus, cause the piston 316 to move downward toward the end 335 of the chamber 306. Such movement of the piston 316 may force some of the wellbore fluid out of the lower portion 325 via the ports 340. As the buffer fluid is permitted to freely expand, the pressure of the buffer fluid within the upper portion 322 and the pressure within the lower portion 321 is maintained substantially equal with the ambient wellbore pressure.

When the downhole tool 110, 210 reaches the intended position within the wellbore 102, 202, the probe assembly 130, 224 may contact the sidewall of the wellbore 102, 202 and the pump 136, 242 may be activated to pump the formation fluid into one or more of the bottles 300. During the sampling operations, the pump 136, 242 may pump the formation fluid into the lower portion 322 of the chamber 302 via the flowline 139, 245 and the port 342 to progressively fill the lower portion 322, causing the piston 312 to move in the upward direction toward the end 332 of the chamber 302. As the formation fluid fills the chamber 302, the buffer fluid within the upper portion 322 is discharged out of the upper portion 322 into the upper portion 326 of the chamber 306, moving the piston 316 in the downward direction until the at least a portion of the piston 316, such as the fluid seal 317, is located within the lower region 392 of the chamber 306. The lower region 392 may form a flow path around the fluid seal 317, permitting the buffer fluid within the upper portion 326 to flow through the channels 319 and around the fluid seal 317 into the lower portion 325 and/or through the ports 340 to be discharged to the wellbore 102, 202. Accordingly, when the piston 316 moves to the lower region 392, the buffer fluid within the upper portion 322 may be continuously discharged to the wellbore 102, 202 until the formation fluid substantially fills the chamber 302 and the piston 312 approaches or contacts the upper end 332 of the chamber 302. Although the buffer fluid is being discharged into the wellbore 102, 202, the buffer fluid within the upper portion 322 is still substantially equal to or slightly greater than the ambient wellbore pressure, thus maintaining the formation fluid within the lower portion 321 pressurized to prevent or reduce expansion of the formation fluid sample into a gaseous state.

As the piston 312 approaches the upper end 332, the piston 312 pushes the lower end 369 of the rod 361 extending into the upper portion 322 in the upward direction until the rod 361 is moved from the first position to the second position. As described above, once the rod 361 moves to the second position, the upper portion 326 of the chamber 306 is fluidly disconnected from the upper portion 322 of the chamber 302, and the lower portion 323 of the chamber 304 is fluidly connected with the upper portion 322. Accordingly, the pressurized buffer fluid within the lower portion 323 is permitted to flow into the upper portion 322 and impart a downward force against the piston 312 to maintain the formation fluid within the lower portion 321 pressurized.

Once the formation fluid sample is pressurized via the pressurized gas, the downhole tool 110, 210 and the bottles 300 may be conveyed to the wellsite surface 106, 206 such that further analysis may be conducted on the sample. As the sample is pressurized via the pressurized gas within the bottle 300, the sample may not expand or change phases as the downhole tool 110, 210 and the bottles 300 are conveyed to the wellsite surface 106, 206.

The following description is directed to a method of operating the multi-phase bottle 400 during the downhole operations and refers to FIGS. 1, 2 and 4-8. Prior to downhole conveyance of the tool 110, 210, the bottle 400 may be filled with the buffer fluid. For example, the upper portion 326 of the chamber 306, the upper portion 322 of the chamber 302, and the fluid pathway 408, may be primed with the buffer fluid such that the piston 312 moves against the bottom end 331 of the chamber 302 and the piston 316 is located in an intermediate location within the chamber 306. One or more bottles 400 may then be installed within or form at least a portion of the sample module 122, 240, such that the ports 342 are fluidly connected with the flowlines 139, 245 and the ports 340 are exposed to the space external to the sample module 122, 240.

During downhole conveyance, as the ambient wellbore pressure increases, wellbore fluid flows into the lower portion 325 via the ports 340 as the volume of the buffer fluid within the upper portion 326 and the upper portion 322 is being compressed and, thus decreased, causing the piston 316 to move upward toward the end 336 of the chamber 306. As the volume of the buffer fluid within the upper portion 322 decreases, the buffer fluid within the upper portion 326 flows into the upper portion 322 via the fluid pathway 408. Accordingly, the pressure of the buffer fluid within the upper portion 322 and the pressure within the lower portion 321 is maintained substantially equal with the ambient wellbore pressure. As the ambient wellbore temperature increases, the buffer fluid within the upper portion 322 may expand. The resulting increase in buffer fluid volume may cause the buffer fluid to flow from the upper portion 322 to the upper portion 326 via the fluid pathway 408 and, thus, cause the piston 316 to move downward toward the end 335 of the chamber 306. Such movement of the piston 316 may force some of the wellbore fluid out of the lower portion 325 via the ports 340. As the buffer fluid is permitted to freely expand, the pressure of the buffer fluid within the upper portion 322 and the pressure within the lower portion 321 is maintained substantially equal with the ambient wellbore pressure.

When the downhole tool 110, 210 reaches the intended position within the wellbore 102, 202, the probe assembly 130, 224 may contact the sidewall of the wellbore 102, 202 and the pump 136, 242 may be activated to pump the formation fluid into one or more of the bottles 400. During the sampling operations, the pump 136, 242 may pump the formation fluid into the lower portion 322 of the chamber 302 via the flowline 139, 245 and the port 342 to progressively fill the lower portion 322, causing the piston 312 to move in the upward direction toward the end 332 of the chamber 302. As the formation fluid fills the chamber 302, the buffer fluid within the upper portion 322 flows out of the upper portion 322 into the upper portion 326 of the chamber 306, moving the piston 316 in the downward direction until at least a portion of the piston 316, such as the fluid seal 317, is located within the lower region 392 of the chamber 306. The lower region 392 may form a flow path around the fluid seal 317, permitting the buffer fluid within the upper portion 326 to flow through the channels 319 and around the fluid seal 317 into the lower portion 325 and/or through the ports 340 to be discharged to the wellbore 102, 202. Accordingly, when the piston 316 moves to the lower region 392, the buffer fluid within the upper portion 322 may be continuously discharged to the wellbore 102, 202 until the formation fluid substantially fills the chamber 302 and the piston 312 approaches or contacts the upper end 332 of the chamber 302.

Once the formation fluid substantially fills the chamber 302, the downhole tool 110, 210 and the bottles 400 may be conveyed to the wellsite surface 106, 206 such that further analysis may be conducted on the sample. The piston 312 and the fluid valve 344 may prevent the sample from escaping from the chamber 302 as the ambient wellbore pressure decreases as the downhole tool 110, 210 and the bottles 400 are conveyed to the wellsite surface 106, 206. Because the sample is not pressurized via the pressurized gas containment section 356 of the bottle 300, the formation fluid sample may expand and a portion of the sample may change into a gaseous state.

In view of the entirety of the present disclosure, including the figures and the claims, a person having ordinary skill in the art should readily recognize that the present disclosure introduces an apparatus comprising a formation fluid sampling bottle comprising: a first chamber; a first piston slidably disposed within the first chamber and dividing the first chamber into first and second portions; a second chamber; and a second piston slidably disposed within the second chamber and dividing the second chamber into third and fourth portions, wherein the third portion is fluidly connected with the second portion, and wherein the fourth portion is fluidly connected with a space external to the sampling bottle.

The first chamber may comprise a port at least partially extending between the first chamber with a source of formation fluid, and the port may be operable to communicate the formation fluid from the source of the formation fluid into the first portion of the first chamber. The source of the formation fluid may comprise a downhole pump and/or a downhole rock formation.

The fourth portion may be located downhole of the third portion.

The space external to the sampling bottle may comprise a wellbore annulus surrounding the apparatus, and the second and third portions may contain a buffer fluid. During downhole sampling operations in such implementations, among others within the scope of the present disclosure, the first portion may be operable to receive formation fluid from a downhole formation, the fourth portion may be operable to receive wellbore fluid from the wellbore annulus, and the buffer fluid may be operable to transmit pressure of the wellbore fluid within the fourth portion to the formation fluid within the first portion. The buffer fluid may comprise water or oil.

The second piston may be slidably disposed about a shaft extending through the second chamber, and the shaft may comprise a longitudinal passageway fluidly connecting the second portion of the first chamber with the third portion of the second chamber.

The space external to the apparatus may comprise a wellbore annulus, the second chamber may comprise a port fluidly connecting the fourth portion of the second chamber with the wellbore annulus, and the port may be operable to communicate wellbore fluid between the wellbore annulus and the fourth portion. In such implementations, among others within the scope of the present disclosure, the sampling bottle may comprise a longitudinal axis, and the port may extend diagonally with respect to the longitudinal axis in a downhole direction from the fourth portion of the second chamber to the wellbore annulus. The second chamber may also or instead comprise an uphole end and a downhole end, and the port may extend from the downhole end of the second chamber to the space external to the apparatus. The second piston may be movable between a first region of the second chamber, in which the second piston may fluidly isolate the third and fourth portions, and a second region of the second chamber, in which the piston may permit fluid flow between the third portion and the port.

The second piston may be movable between an upper region of the second chamber and a lower region of the second chamber, the second piston may be operable to form a fluid seal against an inner surface of the upper region, and the second piston may not be operable to form a fluid seal against an inner surface of the lower region permitting fluid flow between the third portion and the space external to the sampling bottle. In such implementations, among others within the scope of the present disclosure, the first region of the second chamber may comprise a first inner diameter, the second region of the second chamber may comprise a second inner diameter, the second diameter may be substantially larger than the first inner diameter, and wherein the second inner diameter may permit fluid flow across the second piston. The first region of the second chamber may also or instead comprise a continuous inner surface, and the second region of the second chamber may comprise a fluid passage extending between the third portion and the space external to the sampling bottle.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a formation fluid sampling bottle comprising:

a first chamber;

a first piston slidably disposed within the first chamber and dividing the first chamber into first and second portions;

a second chamber; and a second piston slidably disposed within the second chamber and dividing the second chamber into third and fourth portions, wherein the third portion is fluidly connected with the second portion, wherein the fourth portion is fluidly connected with a space external to the sampling bottle, and wherein the fourth portion is positioned between the second portion and the third portion;

wherein the space external to the sampling bottle comprises a wellbore annulus surrounding the apparatus, wherein the second and third portions contain a buffer fluid, and wherein during downhole sampling operations:

the first portion is operable to receive formation fluid from a downhole formation;

the fourth portion is operable to receive wellbore fluid from the wellbore annulus; and the buffer fluid is operable to transmit pressure of the wellbore fluid within the fourth portion to the formation fluid within the first portion.

2. The apparatus of claim 1 wherein the first chamber comprises a port at least partially extending between the first chamber with a source of formation fluid, and wherein the port is operable to communicate the formation fluid from the source of the formation fluid into the first portion of the first chamber.

3. The apparatus of claim 2 wherein the source of the formation fluid comprises a downhole pump.

4. The apparatus of claim 2 wherein the source of the formation fluid comprises a downhole rock formation.

5. The apparatus of claim 1 wherein the fourth portion is located downhole of the third portion.

6. The apparatus of claim 1 wherein the buffer fluid comprises water.

7. The apparatus of claim 1 wherein the buffer fluid comprises oil.

8. The apparatus of claim 1 wherein the second piston is slidably disposed about a shaft extending through the second chamber, and wherein the shaft comprises a longitudinal passageway fluidly connecting the second portion of the first chamber with the third portion of the second chamber.

9. The apparatus of claim 1 wherein the second chamber comprises a port fluidly connecting the fourth portion of the second chamber with the wellbore annulus, and wherein the port is operable to communicate wellbore fluid between the wellbore annulus and the fourth portion.

10. The apparatus of claim 9 wherein the sampling bottle comprises a longitudinal axis, and wherein the port extends diagonally with respect to the longitudinal axis in a downhole direction from the fourth portion of the second chamber to the wellbore annulus.

11. The apparatus of claim 9 wherein the second chamber comprises an uphole end and a downhole end, and wherein the port extends from the downhole end of the second chamber to the space external to the apparatus.

12. The apparatus of claim 9 wherein the second piston is movable between a first region of the second chamber in which the second piston fluidly isolates the third and fourth portions and a second region of the second chamber in which the piston permits fluid flow between the third portion and the port.

13. The apparatus of claim 1 wherein the second piston is movable between an upper region of the second chamber and a lower region of the second chamber, wherein the second piston is operable to form a fluid seal against an inner surface of the upper region, and wherein the second piston is not operable to form a fluid seal against an inner surface of the lower region permitting fluid flow between the third portion and the space external to the sampling bottle.

14. The apparatus of claim 13 wherein the first region of the second chamber comprises a first inner diameter, wherein the second region of the second chamber comprises a second inner diameter, wherein the second diameter is substantially larger than the first inner diameter, and wherein the second inner diameter permits fluid flow across the second piston.

15. The apparatus of claim 13 wherein the first region of the second chamber comprises a continuous inner surface, and wherein the second region of the second chamber comprises a fluid passage extending between the third portion and the space external to the sampling bottle.

16. An apparatus comprising:

a formation fluid sampling bottle comprising:

a first chamber;

a first piston slidably disposed within the first chamber and dividing the first chamber into first and second portions;

a second chamber; and a second piston slidably disposed within the second chamber and dividing the second chamber into third and fourth portions, wherein the third portion is fluidly connected with the second portion, wherein the fourth portion is fluidly connected with a space external to the sampling bottle, and wherein the fourth portion is positioned between the second portion and the third portion;

wherein the space external to the apparatus comprises a wellbore annulus, wherein the second chamber comprises a port fluidly connecting the fourth portion of the second chamber with the wellbore annulus, and wherein the port is operable to communicate wellbore fluid between the wellbore annulus and the fourth portion; and wherein the second piston is movable between a first region of the second chamber in which the second piston fluidly isolates the third and fourth portions and a second region of the second chamber in which the piston permits fluid flow between the third portion and the port.

17. An apparatus comprising:

a formation fluid sampling bottle comprising:

a first chamber;

a first piston slidably disposed within the first chamber and dividing the first chamber into first and second portions;

a second chamber; and a second piston slidably disposed within the second chamber and dividing the second chamber into third and fourth portions, wherein the third portion is fluidly connected with the second portion, wherein the fourth portion is fluidly connected with a space external to the sampling bottle, and wherein the fourth portion is positioned between the second portion and the third portion;

wherein the second piston is movable between an upper region of the second chamber and a lower region of the second chamber, wherein the second piston is operable to form a fluid seal against an inner surface of the upper region, and wherein the second piston is not operable to form a fluid seal against an inner surface of the lower region permitting fluid flow between the third portion and the space external to the sampling bottle.

18. The apparatus of claim 17 wherein the first region of the second chamber comprises a first inner diameter, wherein the second region of the second chamber comprises a second inner diameter, wherein the second diameter is substantially larger than the first inner diameter, and wherein the second inner diameter permits fluid flow across the second piston.

19. The apparatus of claim 17 wherein the first region of the second chamber comprises a continuous inner surface, and wherein the second region of the second chamber comprises a fluid passage extending between the third portion and the space external to the sampling bottle.

* * * * *